United States Patent [19]

Herzog

[11] 4,088,079

[45] May 9, 1978

[54] COMBINATION RAIL, CONVEYOR CHAIN AND RETURN HANGER

[75] Inventor: Raymond A. Herzog, Cincinnati, Ohio

[73] Assignee: The Cincinnati Butchers' Supply Co., Cincinnati, Ohio

[21] Appl. No.: 752,021

[22] Filed: Dec. 20, 1976

[51] Int. Cl.[2] ..... E01B 25/24

[52] U.S. Cl. ..... 104/111; 104/93; 104/110; 104/172 S; 248/228

[58] Field of Search ..... 104/89, 93, 106, 110, 104/111, 172 S; 248/72, 200, 228; 16/90, 93 R, 94 R, 95 R, 96 R; 198/473

[56] References Cited

U.S. PATENT DOCUMENTS

| | | | |
|---|---|---|---|
| 3,039,403 | 6/1962 | McDonough | 104/172 S X |
| 3,411,456 | 11/1968 | Stevens | 104/172 S X |
| 3,835,786 | 9/1974 | McIllwain | 104/172 S |
| 3,837,288 | 9/1974 | Cook | 104/93 X |
| 3,929,078 | 12/1975 | Sears | 104/111 |
| 4,027,598 | 6/1977 | Swilley | 198/473 X |

*Primary Examiner*—Drayton E. Hoffman
*Assistant Examiner*—Randolph A. Reese
*Attorney, Agent, or Firm*—J. Warren Kinney, Jr.

[57] ABSTRACT

A unitary hanger is provided for supporting from the lower web of a single, overhead I-beam support the trolley rail, the advancing reach, and one or more returning reaches of a drop finger conveyor.

16 Claims, 3 Drawing Figures

62
70
16
18
70
68
62
38'
28
64
20
34
38
60
36
58
41
42
10
26
12
55
54

10
62
70
16
68
70
62
64
68
18
64
22
20
66
73
66
73
24
34
46
44
51
46
28
46
44
51
46
36
26
38
30
38
41
38'
30'
38'
42
41
42
41
42
41
40
40
60
40
40
42
48
48
50
50
32
32
14
58
12
55
54
56

COMBINATION RAIL, CONVEYOR CHAIN AND RETURN HANGER

BACKGROUND OF THE INVENTION

1. Field of the Invention

The field of the invention relates to hangers for supporting the trolley rail and the drop finger conveyor of conveyor systems such as, by way of example, are used in slaughter houses and meat packing plants.

2. Description of the Prior Art

U.S. Pat. No. 3,929,078 to R. J. Sears discloses a unitary hanger for supporting the trolley rail and the advancing reach of a drop finger conveyor, wherein the support means for the guides in which the drop finger conveyor chain is mounted are detachably secured to the horizontal head plate of the hanger.

The co-pending patent application of Wilson H. Swilley, Ser. No. 403,227, filed Oct. 3, 1973, now U.S. Pat. No. 4,027,598, assigned to the assignee of this invention, discloses an L-shaped hanger for a trolley rail wherein a horizontally projecting bracket for the support of an elongate T-shaped reciprocating walking beam is bolted to the depending vertical leg of the L-shaped hanger.

The U.S. Pat. No. 1,658,956, to Wehr, and Schmidt U.S. Pat. No. 1,662,539, each disclose means for supporting a trolley rail hanger from the lower web of an I-beam.

The U.S. Pat. No. 852,784, to Hannaford, and the Stevens U.S. Pat. No. 3,411,456 (assigned to the assignee of this invention), each relates to and discloses a unitary hanger for a trolley rail and the advancing reach of the chain of a drop finger conveyor.

The U.S. Pat. No. 3,837,288, to Cook, assigned to the assignee of this invention, discloses a unitary hanger for supporting the trolley rail, wherein a horizontally projecting bracket is secured to a vertical leg of the hanger for supporting a pair of elongate T-shaped walking beams from which a plurality of pivotally mounted drop fingers depend.

None of the aforesaid prior art references, nor any other prior art known to applicant, or his attorney, relate to a unitary hanger for a trolley rail, the advancing reach and one or more returning reaches of a drop finger conveyor.

SUMMARY OF THE INVENTION

The present invention is directed to a unitary device for suspending, not only, a trolley rail, but also the advancing and one or more returning reaches of an endless flexible conveyor chain from which drop fingers are suspended for engaging and advancing wheeled trolleys along said rail from a single overhead support.

Heretofore, the return reach of the endless chain of a drop finger conveyor was suspended from an overhead support by an I-beam from which only the hanger for the return reach was suspended. In other words, one I-beam was used to support the hanger for the conveyor rail and the advancing reach of the drop finger, and another I-beam was required for the hanger of the return reach of said conveyor. This invention eliminates the need for the second I-beam support.

The advancing reach of the conveyor is disposed in substantial vertical alignment with the trolley rail, whereas the return reach is disposed at a location laterally spaced therefrom. The device includes a base plate and means for securely, though releasably, mounting the base plate to an overhead support, wherein a plurality of pairs of members depend from the base plate to define a support for the trolley rail and both the advance and return reaches of the conveyor mechanism.

The device provides accurate alignment of the conveyor with the trolley rail by utilizing but a single support member to mount both reaches of the conveyor and trolley rail from an overhead support such as, by way of example, an I-beam or the like.

DESCRIPTION OF THE PREFERRED EMBODIMENTS

Figure 1:
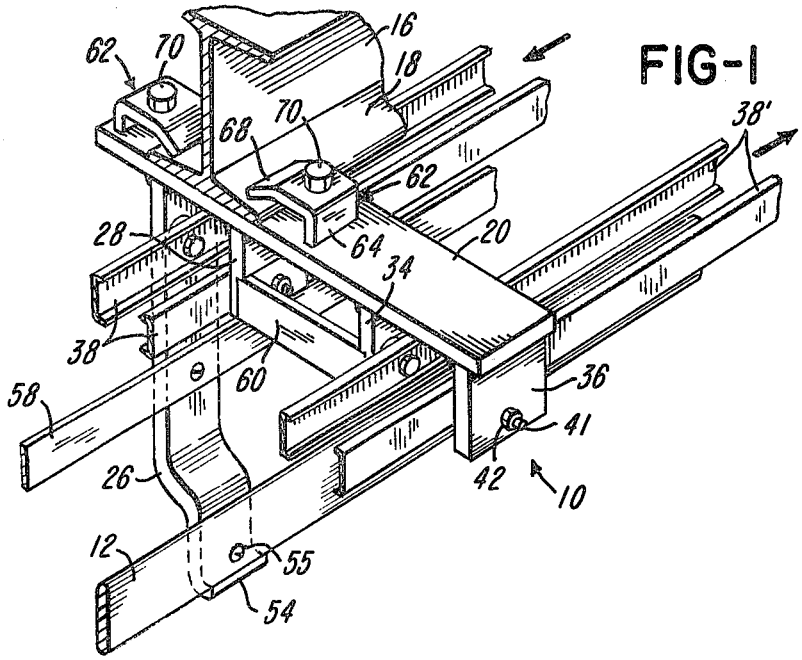
FIG. 1 is a perspective view of a support device embodying the teachings of the present invention.

The support device 10 of the present invention comprises a unitary structure for suspending an elevated trolley rail 12 and conveyor means 14 for advancing a trolley hanger along the trolley rail 12 from an overhead support structure such as, by way of example, I-beam 16 having a lower, substantially horizontal flange 18. The device comprises an elongate base plate 20 having an upper surface 22 disposed in abutting relationship with the lower surface of flange 18, and a lower surface 24.

A first pair of elongate, substantially vertical, spaced, depending members 26 and 28 are secured to the lower surface 24 of the base or mounting plate 20 by suitable means such as, by way of example, welding or the like. The lateral spacing between members 26 and 28 defines a channel for accommodating the side tracks 38 of the advancing reach of an endless, flexible conveyor such as, by way of example, the endless chain 30.

A plurality of drop fingers 32 are secured to, carried by and spaced along the conveyor chain for engaging and advancing a trolley hanger (not shown) along the trolley rail 12.

A second pair of elongate, substantially vertical, spaced, members 34 and 36 depend from the other side of base plate 20 and are spaced from and are disposed outwardly of members 26, 28. Members 34 and 36 define therebetween a second channel for accommodating the side track 38' of the return reach of the flexible conveyor or chain 30' for guiding the endless conveyor along a return reach which is spaced laterally from trolley rail 12 and the advancing reach of the conveyor chain.

Each of the depending members 26, 28, 34 and 36 support a guide-way track 38 or 38' spaced from their respective support members by a spacer 40, wherein each of said tracks is secured in fixed relationship therewith by means such as, by way of example, a bolt-and-nut assembly 41–42.

Preferably, the guide-ways or tracks 38 and 38' are coated with an inherently slippery, self-lubricating fluorocarbon material, such as, by way of example. "Teflon" or the like, whereby the chains 30 which are slidably supported by the guide-ways are subjected to a low co-efficient friction.

Spaced at predetermined intervals in individual links of the conveyor chain, are a plurality of drop fingers 32 which are adapted to engage and advance a trolley (not shown) along rail 12 when the drop finger is disposed within the advancing reach defined by the channel intermediate members 26, 28. The drop fingers are secured to links 33 by means of an upper finger plate 44 and a lower finger plate 48, whereby the link is sandwiched therebetween and held in assembled relationship therewith by a fastener means such as, by way of example, a bolt 51 passing through the upper finger plate 44 and chain link 33, and secured in an internally threaded socket in lower finger plate 48 for securely, though releasably, mounting the drop finger assembly to the endless conveyor. The drop finger is pivotally mounted to lower finger plate 48 by means of a projecting finger-pin 50 and is adapted to engage the upper portion of trolley carried by rail 12 as the conveyor advances in the advancing reach.

Upper finger plate 44 includes a pair of outwardly projecting flanges 46 which are adapted to slide upon the upper edge of the guide-ways 38–38', whereby the conveyor chain is held within and supported by the guide-ways in the channels supported by members 26, 28 and members 34, 36, respectively.

Depending member 26 extends downwardly beyond the flexible-conveyor-receptive channels 38 and terminates in a lower end 54 adapted to receive and support the trolley rail 12 in vertical alignment with the advancing reach of the conveyor. In the preferred embodiment, the conveyor rail 12 is seated on the outwardly projecting flange 54 of member 26 and is securely, though releasably secured thereto by means such as, by way of example, the bolt-and-nut assembly 55–56.

Where desired, a trolley guard 58 may be mounted on member 26 intermediate rail 12 and the lower portion of drop fingers 32 for precluding unintentional rocking or tilting motion of a trolley as it advances along the trolley rail.

A spacer bar 60 is secured to, carried by and spans adjacent depending members 28 and 34 of the pairs of depending members for lending rigidity to the structure.

In the preferred embodiment, base plate 20 is secured to the lower flange 18 of a single I-beam by the clamp lugs 62. Each clamp lug is generally of a general L-shaped configuration comprising a substantially vertically extending leg 64 including a free lower end 66 and a substantially horizontal leg 68 extending over the flange 18 of the I-beam. The horizontal portion of the lug-defining leg 68 of the clamp lug and the base plate 20 include complementary apertures therethrough for receiving tightening means such as, by way of example, bolt 70.

End 66 of leg 64 is disposed in abutting relationship with the upper surface 22 of the base plate. The bolt is engaged by a complementary nut 73 disposed in abutting relationship with the lower surface 24 of the base plate, whereby clamp lug 62 is drawn toward base plate 20 by turning the mounting nut 73 onto bolt 70 to thereby securely, though releasably clamp flange 18 of the I-beam between the lug-defining leg 68 of the clamp lug 62 and the upper surface 22 of the base plate 20. It will be noted that only two clamp lugs 62 are required to securely, though releasably, mount base plate 20 to I-beam 16.

It will be noted that trolley rail 12 is disposed in substantially vertical alignment with the I-beam 16, whereby the depending members which support the most substantial portion of the weight carried by device 10 are in vertical alignment with a rigid overhead support structure.

Figure 3:
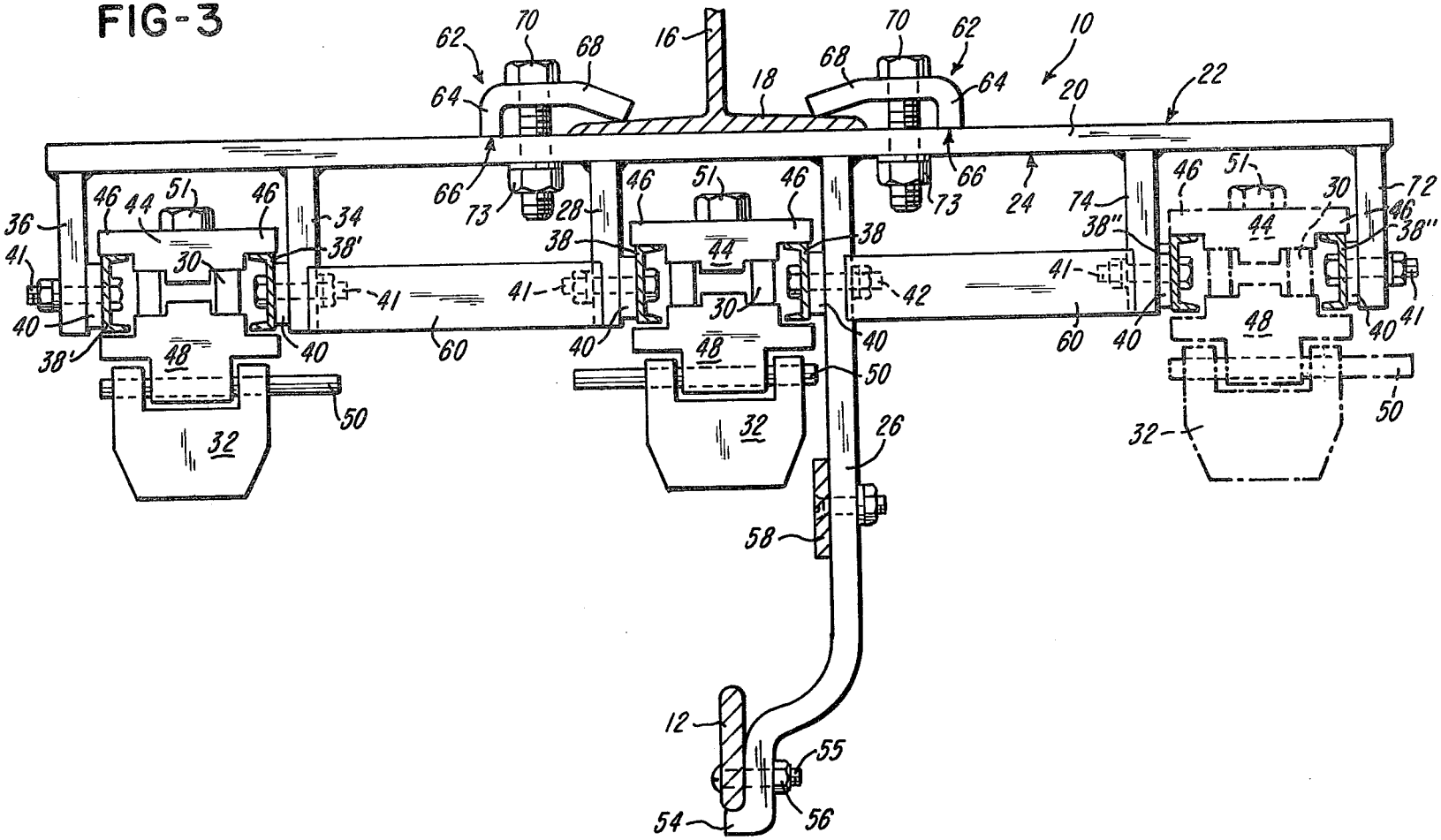
FIG. 3 is a modification of the device illustrated in FIGS. 1 and 2.

An alternative embodiment of the invention is disclosed in FIG. 3, wherein a dual return-reach is provided by utilizing a third pair of depending members 72, 74. These members are secured to base plate 20 by suitable means such as, by way of example, welding.

The third pair of depending members 72, 74 define therebetween an alternate return reach for the conveyor chain and drop fingers 32 carried thereby or for the return reach of another, adjacent conveyor, not illustrated. A spacer bar 60 is secured to, carried by and spans the space between adjacent members 74 and 26 of the first and third pairs of depending members, respectively, for lending rigidity to the structure. Preferably, the advancing reach and the trolley rail are disposed intermediate the two return reaches.

Figure 2:
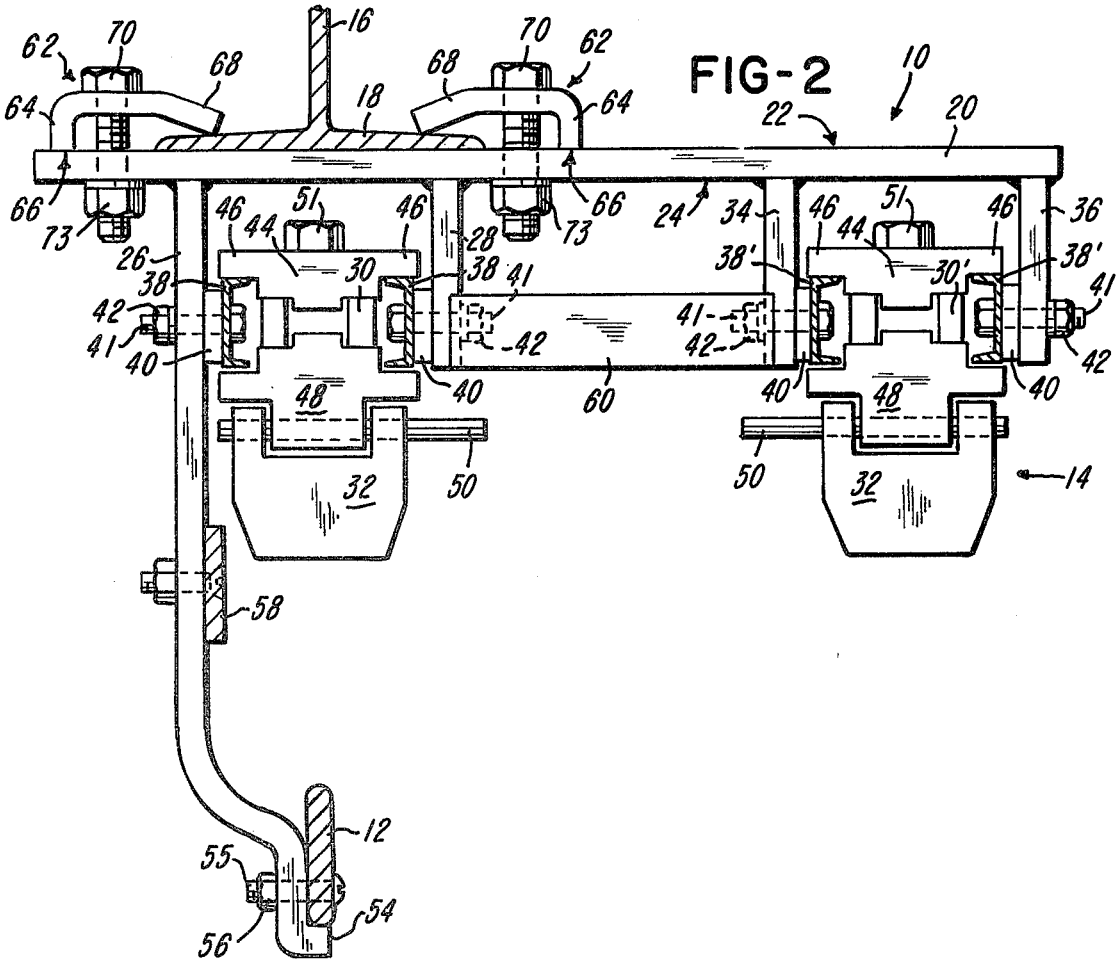
FIG. 2 is an end view of the device of FIG. 1

For ease of understanding, like reference numerals have been applied to those components of the embodiment of FIG. 3 which correspond to like components in the embodiment of FIGS. 1 and 2.

What is claimed is:

1. A unitary device for suspending, from a single, overhead support, an elevated trolley rail and both the advancing and return reaches of an endless, flexible conveyor chain comprising:

a flat, rigid support plate;

at least two pairs of laterally spaced conveyor-chain supporting tracks;

a first pair of elongate, laterally spaced members depending from said support plate and located beneath the overhead support, said first pair of spaced members defining therebetween a support for one pair of laterally spaced tracks, wherein one member of said first pair extends downwardly beyond said tracks and terminates in a trolley-rail support on which a trolley hanger is supported and which is located beneath the overhead support;

a second pair of elongate, laterally spaced members depending from said support plate in lateral spaced relationship with said first pair of depending members, said second pair of members defining therebetween a support for a second pair of laterally spaced tracks and being laterally spaced apart from said trolley-rail support so that said trolley-rail support is located beneath only said first pair of tracks so that trolley hangers are located only beneath the overhead support whereby the most substantial portion of the weight carried by the device is in substantially vertical alignment with the overhead support; and means securely, though releasably, mounting said support plate to the overhead support.

2. A device as called for in claim 1, which includes a third pair of elongate, laterally spaced members which depend from said support plate in lateral spaced relationship with said first pair of depending members, said third pair of members defining therebetween a support for a third pair of laterally spaced tracks.

3. A device as called for in claim 2, wherein the said second and third pair of laterally spaced depending members are disposed on opposite sides of said first pair of depending members.

4. A device as called for in claim 3, wherein an elongate, horizontal spacer is secured to, carried by, and spans the space between the adjacent depending members of the first and second and the first and third pairs of depending members.

5. A device as called for in claim 2, wherein the advancing and return reaches of a first conveyor chain are slideably supported by and between those pairs of laterally spaced tracks which are supported by the said first and second pair of depending members, and wherein the return reach of a second conveyor chain is slideably supported by and between that pair of laterally spaced tracks which are supported by the said third pair of depending members.

6. A device as called for in claim 1, wherein a conveyor chain is slideably supported by and between each pair of laterally spaced tracks.

7. A device as called for in claim 6, wherein drop fingers are hingedly secured to and carried by said conveyor chain.

8. A device as called for in claim 6, wherein the advancing reach of the conveyor chain is supported by that pair of tracks which is supported by the said first pair of depending members.

9. A device as called for in claim 8, wherein the return reach of the conveyor chain is supported by that pair of tracks which is supported by the said second pair of depending members.

10. A device as called for in claim 6, wherein the advancing reach of the conveyor chain is supported by that pair of the depending track-support members which includes the depending member which terminates in a trolley-rail support.

11. A device as called for in claim 10, wherein a trolley-rail is secured to and carried by the said trolley-rail support.

12. A device as called for in claim 6, wherein the conveyor chain supporting tracks are provided with an inherently slippery, self-lubricating fluorocarbon material.

13. A device as called for in claim 1, wherein an elongate, horizontal spacer is secured to, carried by and spans the space between the adjacent depending members of said pairs of depending track-supporting members.

14. A device as called for in claim 1, wherein the device is suspended from the lower web of a single, overhead, I-beam support.

15. A device as called for in claim 14, wherein the means for securely, though releasably, mounting the said support plate to the lower web of an overhead I-beam support comprises a pair of rigid clamps each of which includes one end which is disposed in contact with the upper surface of the support plate, an opposite end which is disposed in overlying relationship with respect to one side of the lower web of an I-beam support, and a portion intermediate said support plate and web engaging ends, the intermediate portion of each clamp having a bolt-receptive aperture therethrough in axial alignment with a bolt-receptive aperture in the support plate, a bolt extending through each of said aligned openings, and a nut on each bolt for drawing the upper surface of the support plate against the under surface of the lower web of the I-beam.

16. A device as called for in claim 1 wherein said support plate is connected directly to the overhead support.

* * * * *